US007257955B2

(12) United States Patent
Lifson et al.

(10) Patent No.: US 7,257,955 B2
(45) Date of Patent: Aug. 21, 2007

(54) DISCHARGE VALVE TO INCREASE HEATING CAPACITY OF HEAT PUMPS

(75) Inventors: Alexander Lifson, Manlius, NY (US); Michael F. Taras, Fayetteville, NY (US)

(73) Assignee: Carrier Corporation, Syracuse, NY (US)

( * ) Notice: Subject to any disclaimer, the term of this patent is extended or adjusted under 35 U.S.C. 154(b) by 360 days.

(21) Appl. No.: 10/936,034

(22) Filed: Sep. 8, 2004

(65) Prior Publication Data

US 2006/0048526 A1 Mar. 9, 2006

(51) Int. Cl.
*F25B 13/00* (2006.01)

(52) U.S. Cl. ..... 62/160; 62/510; 62/513

(58) Field of Classification Search ..... 62/160, 62/159, 222, 228.1, 513, 510
See application file for complete search history.

(56) References Cited

U.S. PATENT DOCUMENTS 2,694,296 A * 11/1954 Prosek et al. ..... 62/278
5,172,564 A * 12/1992 Reedy ..... 62/160
5,263,333 A * 11/1993 Kubo et al. ..... 62/160

* cited by examiner

*Primary Examiner*—Marc Norman
(74) *Attorney, Agent, or Firm*—Carlson, Gaskey & Olds, PC

(57) ABSTRACT

A heat pump is provided with a discharge valve on a discharge line. The discharge valve can be positioned to modulate or pulse refrigerant flow from the discharge line heading toward an indoor heat exchanger, when in a heating mode. By providing this restriction, the pressure and the temperature of the refrigerant increases. This increased temperature provides additional heating capacity as well as increases the temperature of the delivered indoor air, minimizing "cold blow" and making the end user more comfortable. The use of discharge valve can also minimize or entirely eliminate the ON/OFF unit cycling, as the amount of heat delivered can be precisely controlled by pulsing or modulating the valve, thus reducing unit cycling losses, improving user comfort and enhancing reliability.

28 Claims, 2 Drawing Sheets

DISCHARGE VALVE TO INCREASE HEATING CAPACITY OF HEAT PUMPS

BACKGROUND OF THE INVENTION

This invention relates to a heat pump that is operable in both a cooling and a heating mode, and wherein a discharge valve is controlled to increase and modulate the heating capacity of the heat pump.

Refrigerant systems are utilized to control the temperature and humidity of air in various indoor environments to be conditioned. In a typical refrigerant system operating in the cooling mode, a refrigerant is compressed in a compressor and delivered to a condenser (or an outdoor heat exchanger in this case). In the condenser, heat is exchanged between outside ambient air and the refrigerant. From the condenser, the refrigerant passes to an expansion device, at which the refrigerant is expanded to a lower pressure and temperature, and then to an evaporator (or an indoor heat exchanger). In the evaporator heat is exchanged between the refrigerant and the indoor air, to condition the indoor air. When the refrigerant system is operating, the evaporator cools the air that is being supplied to the indoor environment.

The above description is of a refrigerant system being utilized in the cooling mode of operation. In the heating mode, the refrigerant flow through the system is essentially reversed. The indoor heat exchanger becomes the condenser and releases heat into the environment to be conditioned (heated in this case) and the outdoor heat exchanger serves the purpose of the evaporator and exchangers heat with a relatively cold outdoor air. Heat pumps are known as the systems that can reverse the refrigerant flow through the refrigerant cycle, in order to operate in both heating and cooling modes. This is usually achieved by incorporating a four-way reversing valve (or an equivalent device) into the system design, with the valve located downstream of the compressor discharge port. The four-way reversing valve selectively directs the refrigerant flow through the indoor or outdoor heat exchanger when the system is in the heating or cooling mode of operation, respectively. Furthermore, if the expansion device cannot handle the reversed flow, than a pair of expansion devices, each along with a check valve, can be employed instead.

Heat pumps are intended to replace a furnace, such that a single unit can provide the function of both the air conditioner and the furnace. However, heat pumps have not been widely adopted in colder climates. The major reasons for this slow adoption is the concern that the heat pump cannot provide adequate heat in colder climates and/or the temperature of the heated air delivered to the conditioned environment is too cold (so called "cold blow") and uncomfortable to the end user. An additional drawback is that to compensate for the lack of heating capacity, the system needs to rely on separate heaters. Since a heater delivers a predetermined amount of heating capacity, the system must be cycled OFF when the desired indoor temperature is reached and cycled back ON when the temperature falls below the desired value. The unit cycling is inefficient, prone to reliability problems, magnifies temperature variations in the conditioned space and causes discomfort to the end user.

SUMMARY OF THE INVENTION

In a disclosed embodiment of this invention, a four-way reversing valve selectively controls the flow of refrigerant from a compressor discharge to either an outdoor heat exchanger in a cooling mode, or to an indoor heat exchanger in a heating mode. As explained above, the refrigerant flows through a complete cycle under either mode, and returns to the compressor. The flow back to the compressor also passes through the four-way valve.

To provide greater heating capacity delivered by the heat pump, the present invention employs a restriction downstream of the compressor, such that the compressed refrigerant in the discharge line is modulated or pulsed by changing the size of the restriction. Preferably, the restriction is provided by a controllable valve that can be moved to a restricted position when greater heating capacity is desired. By restricting the flow of the refrigerant on the discharge line, the pressure, and thus the temperature, of that refrigerant is increased significantly. In this manner, the heating capacity of the refrigerant when it reaches the indoor heat exchanger is higher. Also modulating or pulsing the valve can add just the right amount of heat such that the system does need to be cycled ON and OFF. This additional amount of heat can be added, for example, to fill the gap between the heating stages of engaging an additional system heating element (often called electric strip heating). Also the extra heat added by modulating or pulsing the valve can be used as a last resort option where more heat is needed but the system has already "topped out" in terms of how much additional heat can be delivered by running the heat pump with all electric strip heaters engaged. In this manner, the conventional heat pump can be relied upon to provide adequate heating in even colder climates.

In one disclosed embodiment, the four-way valve includes a single chamber with a specially configured plunger to selectively communicate indoor and outdoor heat exchangers to either suction or discharge line of the compressor. While a separate valve may be utilized as the restriction defined above, in one preferred embodiment, it is this same four-way valve that is utilized to provide the restriction. By selectively positioning the plunger element relative to the passages, the present invention allows the flow of refrigerant from the compressor discharge line to the indoor heat exchanger to be restricted, such that this flow can be pulsed or modulated to increase the pressure and temperature of the refrigerant.

These and other features of the present invention can be best understood from the following specification and drawings, the following of which is a brief description.

DETAILED DESCRIPTION OF THE PREFERRED EMBODIMENT

Figure 1A:
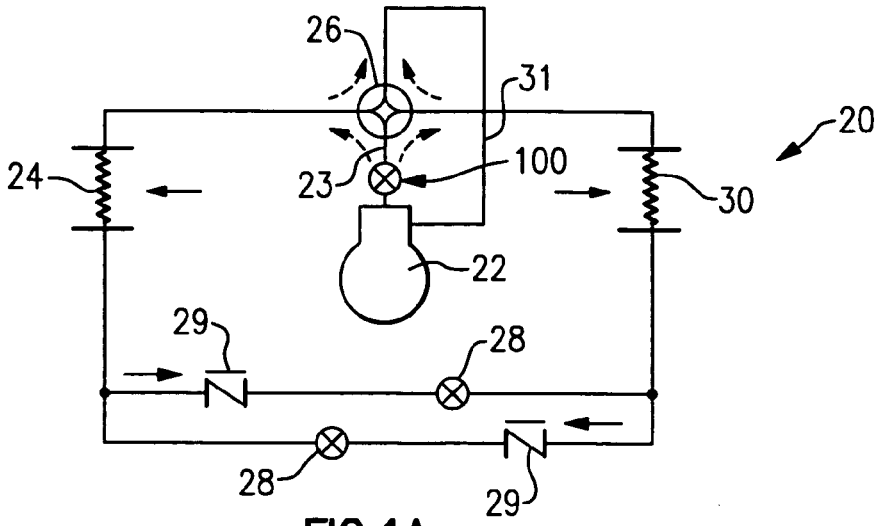
FIG. 1A is a schematic view of a heat pump incorporating the present invention.
Figure 3:
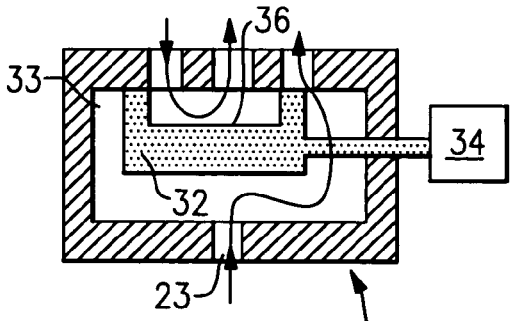
FIG. 3 shows the four-way valve in a position throttling the discharge refrigerant.
Figure 2B:
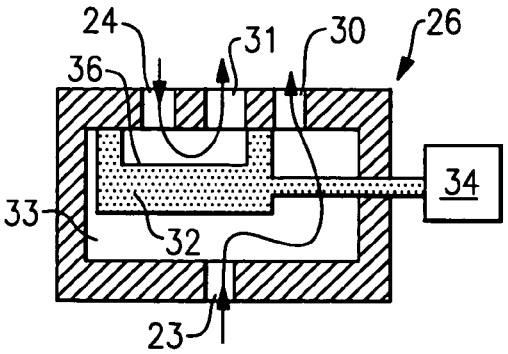
FIG. 2B shows the four-way valve of FIG. 2A in heating mode.
Figure 2A:
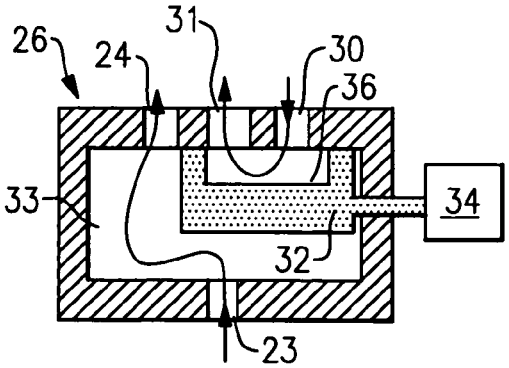
FIG. 2A shows a four-way valve in a cooling mode.

FIG. 1A shows a heat pump refrigerant system 20 incorporating a compressor 22 having a discharge line 23 supplying a compressed refrigerant to a four-way valve 26. Four-way valve 26 selectively communicates the refrigerant from the discharge line 23 either to an outdoor heat exchanger 24, when in a cooling mode, or to an indoor heat exchanger 30, when in a heating mode. As shown in FIGS. 2A, 2B and 3, a control for the four-way valve 26 is operable to position the plunger 32 of the valve 26 as desired. In either case, the refrigerant passes from the first heat exchanger it first encounters after leaving the compressor to one of the main expansion device 28 and associated with check valve 29 assemblies. From the main expansion device, the refrigerant passes through to the second heat exchanger, and back to the four-way valve 26. The four-way valve 26 routes the refrigerant into a suction line 31 leading back to the compressor 22.

This is a very simplified schematic for a heat pump system. It should be understood that much more complex systems are possible, and may incorporate a re-heat circuit, an economizer vapor injection circuit, a bypass around the outdoor heat exchanger 24, a bypass unloading from a compressor intermediate stage back to the compressor suction, etc. It should be understood that the teachings of this invention can be incorporated into any of these more complex heat pump systems.

FIG. 2A shows a detail of the valve 26 when the heat pump 20 is operating in a cooling mode. A control 34 moves the valve plunger element 32 within a valve chamber 33. As shown, a groove 36 in the valve plunger element 32 is positioned to selectively allow the discharge line 23 to communicate with a line leading to the outdoor heat exchanger 24. At the same time, the groove 36 routes the refrigerant from the heat exchanger 30 to the suction line 31. The heat pump 20 with its valve 26 positioned as shown in FIG. 2A is thus operating in a cooling mode.

FIG. 2B shows the valve element 32 moved to a heating mode position. As shown, the refrigerant from the discharge line 23 passes to a line leading to the indoor heat exchanger 30. At the same time, from the outdoor heat exchanger 24, the refrigerant moves through the groove 36, and to the suction line 31 leading back to the compressor 22.

As shown in FIG. 1A, a restriction valve 100 is placed on the discharge line 23. The restriction valve can be placed upstream of the four-way valve as shown in FIG. 1A or downstream of the four-way valve, between the four-way valve and the indoor heat exchanger. When the system is operating in the heating mode, we define the discharge line 23 to include a portion of the line between the compressor and the four-way valve as well as the portion of the line between the four-way valve and the indoor heat exchanger. The restriction valve is operable by a control to either pulse or modulate the flow of refrigerant from the discharge line 23 to the indoor heat exchanger 30. In this manner, the pressure of the discharge refrigerant is increased. By increasing the pressure, one also increases the temperature such that the heating capacity of the refrigerant is higher when it reaches the indoor heat exchanger.

Figure 1B:
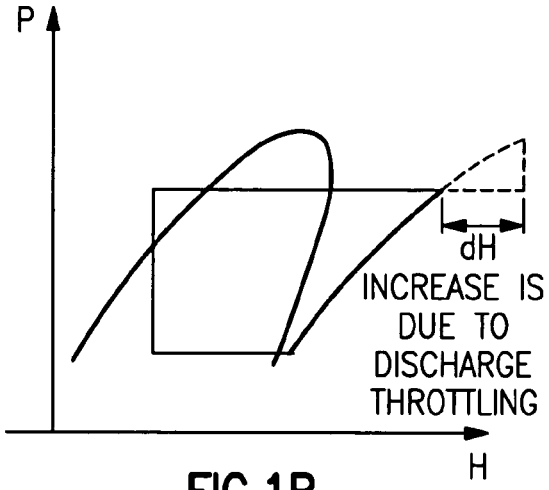
FIG. 1B is a graph explaining one benefit of this invention.

In the pulse mode the size of the restriction is varied on a cyclic basis. The cycling frequency and the amount of restriction opening can be varied to satisfy the required heating demand as shown in FIG. 1B. Typically, in the pulsing mode, the valve opening would vary in two steps—full opening and some amount of restriction. The amount of time the valve spends in the fully open position and in the restricted position can vary with the application. From a reliability perspective, it is more desirable to cycle the valve as infrequently as possible, however for the end user comfort faster cycling may be desired in order to provide close room temperature control and to prevent inadvertent shutoff of the unit, if the temperature in the heated environment will reach higher than expected value. A system designer would, normally carefully consider these cycling rate tradeoffs. While the most typical valve operation in a pulsing mode would call for two positions: fully open and restricted, other combinations would also be possible where there are more than two open positions. If a modulating valve is employed or if the valve is chosen to operate in the modulating mode, instead of a pulsing mode, then the amount of the valve opening is precisely adjusted to match the required heating demand.

Of course, the operation of the valve can be coupled to an information obtained from various sensors and transducers installed in the system. For example, the minimum size of the variable restriction can be limited by the pressure rating of the compressor components or the compressor maximum pressure ratio, therefore if calculations or a pressure transducer installed upstream of the valve indicate that a pressure is reaching a critical value, then the limit is placed on the size of the restriction opening. A similar logic would apply to calculations or measurements of temperature to assure, for example, that the temperature limit at the compressor discharge is not exceeded.

FIG. 1B is a graph showing the standard amount of heating available at various pressures without throttling, and with the discharge chamber being throttled. As can be appreciated, there is an additional amount of heating available as shown by the symbol dH in FIG. 1B.

FIG. 3 shows a control step, wherein the throttling is provided by the four-way valve 26. As shown, the valve control 34 has positioned the valve plunger element 32 such that the heat pump 20 is operating essentially in a heating mode. The valve element 32 is moved to the right from the position shown in FIG. 2B. The refrigerant from the discharge line 23 moving to the indoor heat exchanger 30 is throttled.

Figure 4:
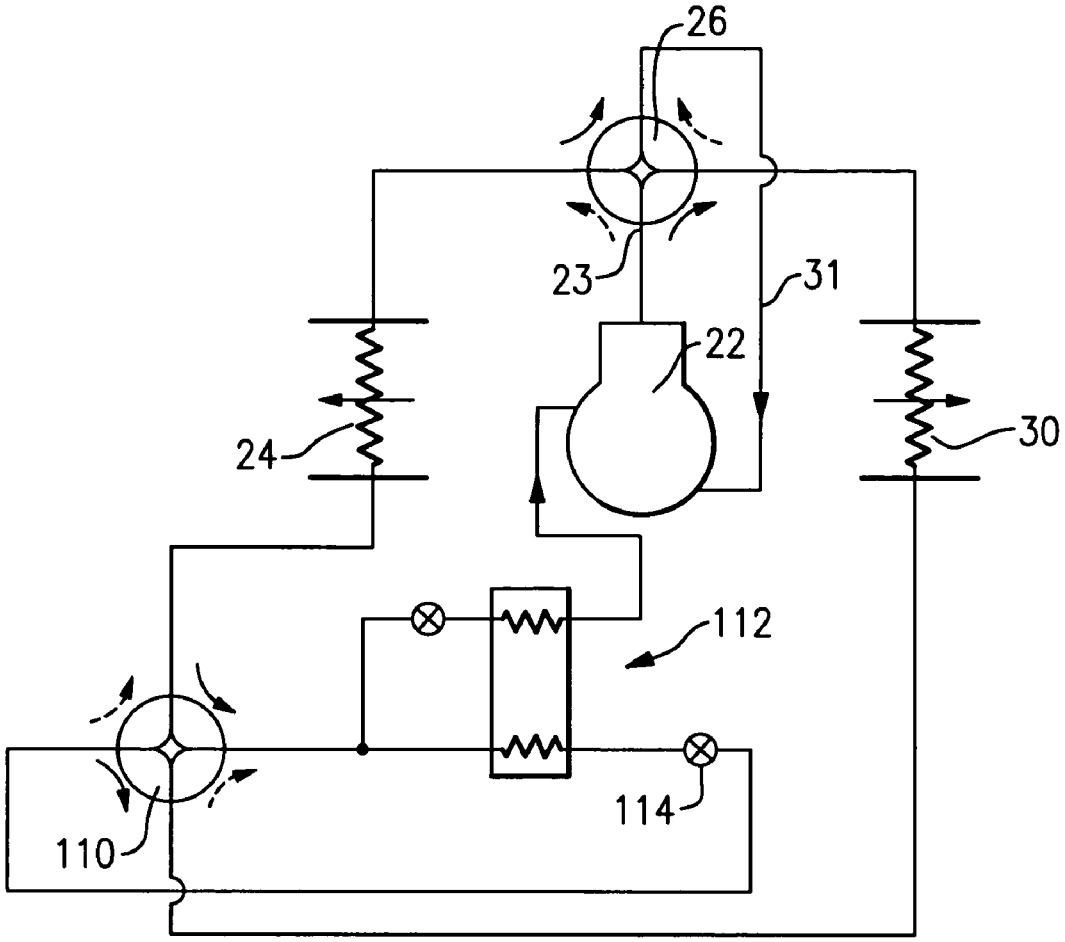
FIG. 4 shows another embodiment.

As shown in FIG. 4, in one embodiment, the throttling is provided by the four-way valve 26, rather than by a separate valve. By positioning the four-way valve such that its valve plunger 32 is positioned to either block flow from the discharge line 23 to the indoor heat exchanger 30, or at least to restrict the flow, throttling the flow and increasing its pressure, the present invention is able to achieve the additional heating such as is illustrated in FIG. 1B. By utilizing the same four-way valve 26 to provide this restriction, the present invention does not require a separate additional valve, and thus minimizes costs. Of course, the described four-way valve can be used either in a pulse or in a modulating mode as described above for a separate valve placed on the compressor discharge line.

FIG. 4 also illustrates the use of the abovementioned concept for the economizer cycle, where, as an example, a second four-way valve 110 is installed for routing refrigerant through an economizer heat exchanger 112 and a main expansion device 114. The economizer cycle provides benefits, as known.

Figure 5:
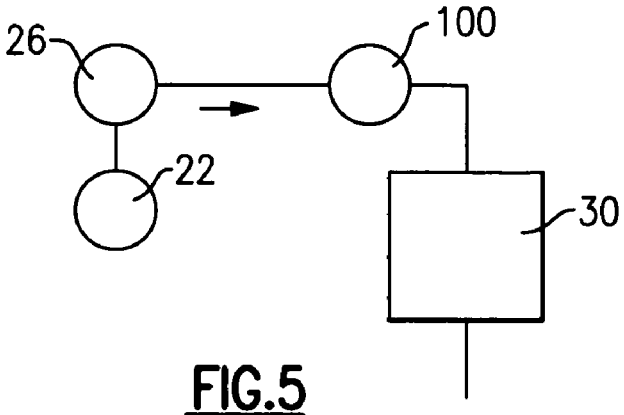
FIG. 5 shows yet another embodiment.

As shown in FIG. 5, a restriction valve 100 can also be located downstream of the routing four-way valve 26.

While preferred embodiments of this invention has been disclosed, a worker of ordinary skill in this art would recognize that certain modifications would come within the scope of this invention. For that reason, the following claims should be studied to determine the true scope and content of this invention.

What is claimed is:

1. A heat pump comprising:

a compressor for delivering a compressed refrigerant to a discharge line;

a routing valve for selectively routing refrigerant from said discharge line to either an outdoor heat exchanger when in a cooling mode, and to an indoor heat exchanger when in a heating mode, a discharge flow restrictor further being selectively operable to restrict flow between the discharge line and the indoor heat exchanger; and said discharge flow restrictor being a single discharge flow restrictor on a single discharge line leading from said compressor to a single indoor heat exchanger.

2. The heat pump as set forth in claim 1, wherein said routing valve includes an element movable to control flow of refrigerant.

3. The heat pump as set forth in claim 2, wherein said element is movable within a chamber, and said chamber receiving said fluid communication to said discharge line and a compressor suction line, and having separate lines leading to each of said indoor and outdoor heat exchangers, said element being positioned to selectively communicate said discharge line to one of said indoor and outdoor heat exchangers, and to communicate the other of said indoor and outdoor heat exchangers to said suction line, dependent on whether said heat pump is in a cooling or heating mode.

4. The heat pump as set forth in claim 1, wherein said discharge flow restrictor is an independent restrictor positioned in the discharge line.

5. The heat pump as set forth in claim 4, wherein said discharge flow restrictor is a valve.

6. The heat pump as set forth in claim 5, wherein said valve is a solenoid valve.

7. The heat pump as set forth in claim 1, wherein said discharge flow restrictor is positioned downstream of the said routing valve.

8. The heat pump as set forth in claim 1, wherein an opening through said discharge flow restrictor can be adjusted by pulsing the said discharge flow restrictor.

9. The heat pump as set forth in claim 8, wherein the pulsing can be accomplished by adjusting the opening between at least two positions.

10. The heat pump as set forth in claim 9, wherein at least one position is a fully open position.

11. The heat pump as set forth in claim 9, wherein at least one position is a restricted flow position.

12. The heat pump as set forth in claim 9, wherein the duration of time the discharge flow restrictor spends in each said position can be adjusted.

13. The heat pump as set forth in claim 1, wherein an opening of said discharge flow restrictor can be adjusted by modulating a restrictor flow area.

14. The heat pump as set forth in claim 1, wherein the open area of said flow restrictor can be continuously adjusted.

15. The heat pump as set forth in claim 1, wherein an economizer circuit is positioned within the refrigerant system intermediate the indoor and outdoor heat exchangers.

16. A heat pump comprising:

a compressor for delivering a compressed refrigerant to a discharge line;

a routing valve for selectively routing refrigerant from said discharge line to either an outdoor heat exchanger when in a cooling mode, and to an indoor heat exchanger when in a heating mode, a discharge flow restrictor further being selectively operable to restrict flow between the discharge line and the indoor heat exchanger; and said discharge flow restrictor is a part of said routing valve that is utilized as said discharge flow restrictor.

17. A heat pump comprising:

a compressor for delivering a compressed refrigerant to a discharge line;

a routing valve for selectively routing refrigerant from said discharge line to either an outdoor heat exchanger when in a cooling mode, and to an indoor heat exchanger when in a heating mode, a discharge flow restrictor further being selectively operable to restrict flow between the discharge line and the indoor heat exchanger;

said routing valve includes an element movable to control flow of refrigerant;

said element is movable within a chamber, and said chamber receiving said fluid communication to said discharge line, and said compressor suction line, and having separate lines leading to each of said indoor and outdoor heat exchangers, said element being positioned to selectively communicate said discharge line to one of said indoor and outdoor heat exchangers, and to communicate the other of said indoor and outdoor heat exchangers to said suction line, dependent on whether said heat pump is in a cooling or heating mode; and said element further being positioned when in a restrictive position to selectively restrict refrigerant from said discharge line passing to said indoor heat exchanger to provide said discharge flow restrictor.

18. A heat pump comprising:

a compressor for delivering a compressed refrigerant to a discharge line;

a routing valve for selectively routing refrigerant from said discharge line to either an outdoor heat exchanger when in a cooling mode, and to an indoor heat exchanger when in a heating mode, a discharge flow restrictor further being selectively operable to restrict flow between the discharge line and the indoor heat exchanger; and said discharge flow restrictor is positioned upstream of the said routing valve.

19. The heat pump as set forth in claim 18, wherein said discharge flow restrictor is an independent restrictor positioned in the discharge line.

20. The heat pump as set forth in claim 19, wherein said discharge flow restrictor is a valve.

21. The heat pump as set forth in claim 20, wherein said valve is a solenoid valve.

22. The heat pump as set forth in claim 18, wherein an opening through said discharge flow restrictor can be adjusted by pulsing said flow restrictor.

23. The heat pump as set forth in claim 22, wherein the pulsing can be accomplished by adjusting the opening between at least two positions.

24. The heat pump as set forth in claim 23, wherein at least one position is a fully open position.

25. The heat pump as set forth in claim 23, wherein at least one position is a restricted flow position.

26. The heat pump as set forth in claim 23, wherein the duration of time the discharge flow restrictor spends in each said position can be adjusted.

27. The heat pump as set forth in claim 18, wherein refrigerant passing through the discharge flow restrictor passes downstream to both the indoor and outdoor heat exchangers, dependent upon the position of the routing valve.

28. The heat pump as set forth in claim 18, wherein an economizer circuit is positioned within the refrigerant system intermediate the indoor and outdoor heat exchangers.

* * * * *

UNITED STATES PATENT AND TRADEMARK OFFICE

CERTIFICATE OF CORRECTION

PATENT NO. : 7,257,955 B2
APPLICATION NO. : 10/936034
DATED : August 21, 2007
INVENTOR(S) : Lifson et al.

It is certified that error appears in the above-identified patent and that said Letters Patent is hereby corrected as shown below:

Claim 14, Column 5, line 47: insert --discharge-- after “said” and before “flow”

Signed and Sealed this

Twenty-seventh Day of November, 2007

JON W. DUDAS
*Director of the United States Patent and Trademark Office*